US009574157B2

(12) United States Patent
Narita et al.

(10) Patent No.: US 9,574,157 B2
(45) Date of Patent: Feb. 21, 2017

(54) LUBRICANT COMPOSITION

(71) Applicant: IDEMITSU KOSAN CO., LTD., Chiyoda-ku (JP)

(72) Inventors: Keiichi Narita, Ichihara (JP); Toshiaki Iwai, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/374,350

(22) PCT Filed: Mar. 12, 2013

(86) PCT No.: PCT/JP2013/056819
§ 371 (c)(1),
(2) Date: Jul. 24, 2014

(87) PCT Pub. No.: WO2013/137258
PCT Pub. Date: Sep. 19, 2013

(65) Prior Publication Data

US 2014/0378357 A1 Dec. 25, 2014

(30) Foreign Application Priority Data

Mar. 14, 2012 (JP) ..... 2012-057496

(51) Int. Cl.

| | |
|---|---|
| ***C10M 141/10*** | (2006.01) |
| ***C10M 159/20*** | (2006.01) |
| ***C10M 135/10*** | (2006.01) |
| ***C10M 137/02*** | (2006.01) |
| ***C10M 163/00*** | (2006.01) |
| *C10M 133/06* | (2006.01) |
| *C10M 137/04* | (2006.01) |

(52) U.S. Cl.
CPC ..... *C10M 141/10* (2013.01); *C10M 135/10* (2013.01); *C10M 137/02* (2013.01); *C10M 163/00* (2013.01); *C10M 133/06* (2013.01); *C10M 137/04* (2013.01); *C10M 2207/028* (2013.01); *C10M 2207/262* (2013.01); *C10M 2215/04* (2013.01); *C10M 2219/046* (2013.01); *C10M 2223/04* (2013.01); *C10M 2223/049* (2013.01); *C10N 2210/02* (2013.01); *C10N 2230/06* (2013.01); *C10N 2230/76* (2013.01); *C10N 2240/045* (2013.01)

(58) Field of Classification Search
CPC . C10M 133/06; C10M 135/10; C10M 137/02; C10M 137/04; C10M 141/10; C10M 163/00; C10M 2207/028; C10M 2207/262; C10M 2215/04; C10M 2219/046; C10M 2223/04; C10M 2223/049; C10N 2210/02; C10N 2230/06; C10N 2230/76
USPC ..... 508/399, 433, 434, 545
See application file for complete search history.

(56) References Cited

U.S. PATENT DOCUMENTS

| | | | | |
|---|---|---|---|---|
| 4,795,583 | A * | 1/1989 | Papay | 252/77 |
| 6,320,088 | B1 * | 11/2001 | Matsuno et al. | 585/21 |
| 2004/0005988 | A1 * | 1/2004 | Watanabe et al. | 508/192 |
| 2005/0124506 | A1 * | 6/2005 | Shiga et al. | 508/194 |
| 2007/0004603 | A1 * | 1/2007 | Iyer | C10M 141/10 508/441 |
| 2008/0139424 | A1 | 6/2008 | Komatsubara et al. | |
| 2010/0216676 | A1 | 8/2010 | Ichihashi et al. | |
| 2011/0053816 | A1 * | 3/2011 | Narita | 508/408 |
| 2012/0149619 | A1 | 6/2012 | Narita | |
| 2012/0270693 | A1 | 10/2012 | Ando et al. | |

FOREIGN PATENT DOCUMENTS

| | | |
|---|---|---|
| EP | 1 918 356 A1 | 5/2008 |
| JP | 2000-355695 A | 12/2000 |
| JP | 2001-288488 | 10/2001 |
| JP | 2007-238764 | 9/2007 |
| JP | 2009-167337 | 7/2009 |
| WO | WO 2011/037054 A1 | 3/2011 |
| WO | WO 2011/062282 A1 | 5/2011 |

OTHER PUBLICATIONS

International Search Report issued Jun. 18, 2013, in PCT/JP13/056819 filed Mar. 12, 2013.
Extended European Search Report issued Oct. 19, 2015 in Patent Application No. 13760336.1.

* cited by examiner

*Primary Examiner* — James Goloboy
(74) *Attorney, Agent, or Firm* — Oblon, McClelland, Maier & Neustadt, L.L.P.

(57) ABSTRACT

A lubricating oil composition contains a lubricating base oil and components (A) to (D): (A) a primary amine; (B) a tertiary amine; (C) at least one of metal sulfonate, metal phenate and metal salicylate; and (D) at least one of acid phosphate and acid phosphite.

10 Claims, No Drawings

LUBRICANT COMPOSITION

TECHNICAL FIELD

The present invention relates to a lubricating oil composition suitable for a continuously variable transmission.

BACKGROUND ART

Recently, a metallic belt-type continuously variable transmission and a toroidal continuously variable transmission have been developed as a transmission for an automobile and the like and have already been in practical use. Initially, a lubricating oil for an automatic transmission was also used for a continuously variable transmission. However, in accordance with an improvement in performance of the continuously variable transmission, the lubricating oil has been required to have more excellent properties. Particularly, since a friction property of a lubricating oil used for a wet clutch in an automatic transmission has been optimized for an automatic transmission, a friction coefficient between metals of the lubricating oil is likely to be insufficient when the lubricating oil is used for a continuously variable transmission, so that it is difficult to transmit a large volume of torque.

For this reason, various lubricating oils usable for a continuously variable transmission have been developed. For instance, there have been proposed a lubricating oil composition containing (a) alkaline earth metal sulfonate or phenate, (b) an imide compound and (c) a phosphorus compound (see Patent Literature 1) and a lubricating oil composition containing: (A) at least one phosphorus-containing compound selected from phosphoric monoester, phosphoric diester and phosphorus monoester, which each have a hydrocarbon group having 1 to 8 carbon atoms; and (B) a tertiary amine compound substituted by a hydrocarbon group having 6 to 10 carbon atoms (see Patent Literature 2). Moreover, a lubricating oil composition containing (A) a tertiary amine, (B) acid phosphate and the like and (C) metal sulfonate and the like has also been proposed (see Patent Literature 3). The lubricating oil compositions disclosed in these Patent Literatures have a high friction coefficient between metals suitable for a lubricating oil for a continuously variable transmission.

CITATION LIST

Patent Literature(s)

Patent Literature 1: JP-A-2001-288488
Patent Literature 2: JP-A-2009-167337
Patent Literature 3: WO2011/037054

SUMMARY OF THE INVENTION

Problems to be Solved by the Invention

A continuously variable transmission itself is also further improved. A continuously variable transmission including a torque convertor provided with a lockup clutch in a starting mechanism has been on the market. Moreover, recently, a continuously variable transmission including a mechanism to intentionally slip a lockup clutch (a slip control) is often used in order to improve fuel consumption in a lockup speed range and to attenuate shock in engagement of a lockup clutch. Since self-induced vibration called shudder is likely to occur depending on a lubricating oil when such a slip control is conducted, an oil for a continuously variable transmission is required to have an initial shudder prevention performance and a long shudder prevention lifetime. However, the lubricating oil compositions disclosed in the above Patent Literatures 1 to 3 are not always sufficient in terms of the initial shudder prevention performance and the shudder prevention lifetime although exhibiting a high friction coefficient between metals.

An object of the invention is to provide a lubricating oil composition having a high friction coefficient between metals, an excellent initial shudder prevention performance and a long shudder prevention lifetime.

Means for Solving the Problems

In order to solve the above problems, the invention provides a lubricating oil composition below.

(1) A lubricating oil composition according to an aspect of the invention contains a lubricating base oil, a component (A) being a primary amine, a component (B) being a tertiary amine, a component (C) being at least one of metal sulfonate, metal phenate and metal salicylate, and a component (D) being at least one of acid phosphate and acid phosphite.

(2) In the lubricating oil composition according to the above aspect of the invention, the component (A) is diamine.

(3) In the lubricating oil composition according to the above aspect of the invention, a content of nitrogen derived from the component (A) is 0.001 mass % or more of a total amount of the lubricating oil composition.

(4) In the lubricating oil composition according to the above aspect of the invention, a content of nitrogen derived from the component (B) is 0.005 mass % or more of the total amount of the lubricating oil composition.

(5) In the lubricating oil composition according to the above aspect of the invention, the component (C) is an alkaline earth metal salt.

(6) In the lubricating oil composition according to the above aspect of the invention, a content of metal derived from the component (C) is in a range of 0.01 mass % to 0.1 mass % of the total amount of the lubricating oil composition.

(7) In the lubricating oil composition according to the above aspect of the invention, a content of phosphorous derived from the component (D) is 0.02 mass % or more of the total amount of the lubricating oil composition.

(8) The lubricating oil composition according to the above aspect of the invention is used for a continuously variable transmission.

According to the lubricating oil composition of the above aspect of the invention, since the lubricating base oil contains specific four components, a friction coefficient between metals is high, initial shudder prevention performance is excellent and a shudder prevention lifetime is also long. Accordingly, the lubricating oil composition of the above aspect of the invention is particularly preferably usable as a continuously variable transmission including a torque convertor provided with a lockup clutch.

DESCRIPTION OF EMBODIMENT(S)

A lubricating oil composition in an exemplary embodiment is provided by blending the above components (A) to (D) with a lubricating base oil. The lubricating oil composition in the exemplary embodiment will be described in detail below.

Lubricating Base Oil

A lubricating base oil usable in the exemplary embodiment may be at least one of mineral oil(s) and synthetic oil(s), specifically, one of the mineral oil(s) and the synthetic oil(s), or a combination of two or more thereof.

The mineral oil and the synthetic oil are not limited to specific ones, but are preferable as long as being generally usable as a base oil for a transmission. The mineral oil and the synthetic oil are preferably has a kinematic viscosity at 100 degrees C. in a range of 1 $mm^2/s$ to 50 $mm^2/s$, particularly in a range of 2 $mm^2/s$ to 15 $mm^2/s$. At an excessively high kinematic viscosity, a low-temperature viscosity is deteriorated. At an excessively low kinematic viscosity, wear at sliding parts such as a gear bearing and a clutch may be increased.

A pour point of the lubricating base oil, which is an index of a low-temperature fluidity, is not particularly limited, but is preferably minus 10 degrees C. or less, particularly preferably minus 15 degrees C. or less.

Further, the lubricating base oil preferably has a saturated hydrocarbon component of 90 mass % or more, a sulfur content of 0.03 mass % or less and a viscosity index of 100 or more. When the saturated hydrocarbon component is less than 90 mass %, deteriorated products may often be produced. Moreover, when the sulfur content is more than 0.03 mass %, deteriorated products may often be produced. Further, when the viscosity index is less than 100, wear at a high temperature may be increased.

Examples of the mineral oil include a naphthenic mineral oil, a paraffinic mineral oil and GTL WAX. Specific examples of the mineral oil include light neutral oil, intermediate neutral oil, heavy neutral oil, and bright stock.

On the other hand, examples of the synthetic oil include polybutene, a hydride thereof, poly-α-olefin (e.g., 1-octene oligomer, 1-decene oligomer), α-olefin copolymer, alkylbenzene, polyolester, diacid ester, polyoxyalkyleneglycol, polyoxyalkyleneglycolester, polyoxyalkyleneglycolether, hindered ester and silicone oil.

Component (A)

The component (A) used in the exemplary embodiment is preferably a primary amine having a structure represented, for instance, by a formula (1) below.

[Formula 1]

$$R^1—NH_2 \quad (1)$$

Herein, $R^1$ is preferably a hydrocarbon group having 16 to 22 carbon atoms. When the number of the carbon atoms falls within this range, a friction coefficient between metals can be effectively increased. Examples of the hydrocarbon group include an alkyl group, alkenyl group, aryl group and aralkyl group. Among the hydrocarbon groups, an aliphatic hydrocarbon group is preferable, among which an alkenyl group is particularly preferable. Accordingly, examples of $R^1$ include a hexadecyl group, heptadecyl group, octadecyl group, nonadecyl group, eicosyl group, heneicosyl group, docosyl group and oleyl group, among which an oleyl group is the most preferable.

A carbon chain moiety may be in a linear structure or a branched structure, but a carbon chain moiety in a linear structure is particularly preferable in terms of an increase in the friction coefficient between metals.

The primary amine as the component (A) may be diamine represented by a formula (2) below.

[Formula 2]

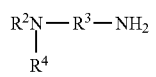

(2)

Preferable $R^2$ represents the same as $R^1$ of the formula (1). $R^3$ is a divalent hydrocarbon group, among which an alkylene group is preferable. $R^3$ preferably has 1 to 5 carbon atoms in terms of stability, particularly preferably 3 carbon atoms. $R^4$ is hydrogen or a hydrocarbon group. When $R^4$ is a hydrocarbon group, an alkyl group is preferable. $R^4$ preferably has 3 or less carbon atoms. $R^4$ is particularly preferably hydrogen.

In terms of both the shudder prevention effect and the shudder prevention lifetime, the component (A) is preferably contained such that a content of nitrogen derived from the component (A) is 0.001 mass % or more of a total amount of the composition, more preferably 0.01 mass % or more, further preferably 0.02 mass % or more. However, an unnecessarily large content of the component (A) does not result in further improvement in the shudder prevention effect and the shudder prevention lifetime. Accordingly, the content of the component (A) is desirably restricted such that the content of nitrogen derived from the component (A) is 0.1 mass % or less.

The aforementioned primary amine represented by the formula (1) and diamine represented by the formula (2) may be mixed in use.

Component (B)

A component (B) used in the exemplary embodiment is a tertiary amine. The tertiary amine preferably has a structure represented, for instance, by a formula (3) below.

[Formula 3]

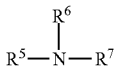

(3)

Herein, $R^5$ is preferably a hydrocarbon group having 16 to 22 carbon atoms. When the number of the carbon atoms falls within this range, a friction coefficient between metals can be effectively increased. Examples of the hydrocarbon group include an alkyl group, alkenyl group, aryl group and aralkyl group. Among the hydrocarbon group, an aliphatic hydrocarbon group is preferable, among which an aliphatic hydrocarbon group having a saturated structure is particularly preferable. Accordingly, examples of $R^5$ include a hexadecyl group, heptadecyl group, octadecyl group, nonadecyl group, eicosyl group, heneicosyl group and docosyl group, among which an octadecyl group is the most preferable.

Each of $R^6$ and $R^7$ is preferably a hydrocarbon group having 1 or 2 carbon atoms. Specifically, each of $R^6$ and $R^7$ is a methyl group, ethyl group and vinyl group. When the number of the carbon atoms of each of $R^6$ and $R^7$ falls within this range, the shudder prevention effect can be considerably exhibited. Moreover, in terms of stability, each of $R^6$ and $R^7$ is preferably a methyl group or an ethyl group rather than a vinyl group having an unsaturated structure. Respective terminal moieties of $R^6$ and $R^7$ may be bonded to each other to form a heterocycle.

Specific examples of the component (B) include dimethylhexadecylamine, dimethyloctadecylamine, dimehtylheneicosylamine, diethyloctadecylamine and methylethyloctadecylamine. One of the component (B) in the form of the tertiary amine in the exemplary embodiment may be used alone or a combination of two or more thereof may be used.

In terms of both the shudder prevention effect and the shudder prevention lifetime, a content of nitrogen derived from the component (B) is preferably 0.005 mass % or more of the total amount of the composition, more preferably 0.01 mass % or more, further preferably 0.02 mass % or more. However, an unnecessarily large content of the component (B) does not result in further improvement in the shudder prevention effect and the shudder prevention lifetime. Accordingly, the content of the component (B) is desirably restricted such that the content of nitrogen derived from the component (B) is 0.1 mass % or less.

Component (C)

A component (C) used in the exemplary embodiment is at least one of metal sulfonate, metal phenate and metal salicylate. The friction coefficient between metals is increased by blending such metal compound(s). Particularly, the metal compound is preferably at least one selected from the group consisting of alkaline earth metal sulfonate, alkaline earth metal phenate and alkaline earth metal salicylate. A combination of the compound (B) and the compound (C) synergistically improves the friction coefficient between metals.

An example of alkaline earth metal sulfonate is an alkaline earth metal salt of alkyl aromatic sulfonic acid obtained by sulfonating an alkyl aromatic compound preferably having a mass average molecular weight of 300 to 1500, more preferably 400 to 700. The alkaline earth metal salt thereof is particularly exemplified by a magnesium salt and a calcium salt, among which a calcium salt is preferably used.

An example of alkaline earth metal phenate is an alkaline earth metal salt of alkylphenol, alkylphenol sulfide and a Mannich reaction product of alkylphenol. The alkaline earth metal salt thereof is particularly exemplified by a magnesium salt and a calcium salt, among which a calcium salt is preferably usable.

An example of alkaline earth metal salicylate is an alkaline earth metal salt of alkyl salicylic acid, which is particularly exemplified by a magnesium salt and a calcium salt, among which a calcium salt is preferably usable.

The aforementioned alkaline earth metal compound preferably contains an alkyl group having a linear chain or a branched chain, in which the alkyl group preferably has 4 to 30 carbon atoms, more preferably 6 to 18 carbon atoms. Moreover, all of a neutral salt, a basic salt and an overbased salt of the alkaline earth metal compound are usable. A total base value of the alkaline earth metal compound is preferably in a range of 10 mgKOH/g to 500 mg KOH/g, more preferably in a range of 15 mgKOH/g to 450 mgKOH/g.

A content of the metal compound as the component (C) is preferably in a range of 0.01 mass % to 0.1 mass % of the total amount of the composition in terms of a metal content, more preferably in a range of 0.02 mass % to 0.08 mass %. When the content of the metal compound falls within this range, the advantages of the invention can be more preferably exhibited. In addition, one of the components (C) may be used alone or a combination of two or more thereof may be used.

A component (D) used in the exemplary embodiment is at least one of acid phosphate and acid phosphite. Specifically, an acid monophosphate and an acid diphosphate which are represented by a formula (4) below and an acid phosphite represented by a formula (5) below are preferable.

[Formula 4]

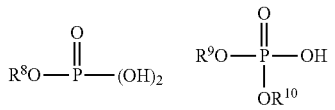

(4)

-continued

[Formula 5]

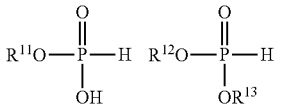

(5)

In the formulae (4) and (5), $R^8$, $R^9$, $R^{10}$, $R^{11}$, $R^{12}$ and $R^{13}$ are each a hydrocarbon group, among which a hydrocarbon group having 8 carbon atoms or less is preferable. When the number of the carbon atoms of the hydrocarbon group is more than 8, friction coefficient between metals may not be increased.

Examples of the hydrocarbon group having 8 carbon atoms or less include an alkyl group having 8 carbon atoms or less, an alkenyl group having 8 carbon atoms or less, an aryl group having 6 to 8 carbon atoms and an aralkyl group having 7 or 8 carbon atoms. The alkyl group and alkenyl group may be linear, branched or cyclic. Examples of the alkyl group and alkenyl group include a methyl group, ethyl group, n-propyl group, isopropyl group, n-butyl group, isobutyl group, sec-butyl group, tert-butyl group, various pentyl groups, various hexyl groups, various heptyl groups, various octyl groups, cyclopentyl group, cyclohexyl group, allyl group, propenyl group, various butenyl groups, various hexenyl groups, various octenyl groups, cyclopentenyl group and cyclohexenyl group.

Examples of the aryl group having 6 to 8 carbon atoms include a phenyl group, tolyl group and xylyl group. Examples of the aralkyl group having 7 or 8 carbon atoms include a benzyl group, phenethyl group and methylbenzyl group.

Examples of the acid monophosphate represented by the formula (4) include monoethyl acid phosphate, mono-n-propyl acid phosphate, mono-n-butyl acid phosphate and mono-2-ethylhexyl acid phosphate. Examples of the acid diphosphate represented by the formula (5) include diethyl acid phosphate, di-n-propyl acid phosphate, di-n-butyl acid phosphate and di-2-ethylhexyl acid phosphate. Examples of the acid phosphite include ethyl hydrogen phosphite, n-propyl hydrogen phosphite, n-butyl hydrogen phosphite, 2-ethylhexyl hydrogen phosphite, di-2-ethylhexyl hydrogen phosphite, dilauryl hydrogen phosphite and dioleyl hydrogen phosphite.

As the component (D) in the exemplary embodiment, one of the above phosphate/phosphite compounds may be used alone or a combination of two or more thereof may be used. A content of phosphorous derived from the component (D) is preferably 0.02 mass % or more of the total amount of the lubricating oil composition, more preferably in a range of 0.03 mass % to 0.09 mass %. At the content of the component (D) of 0.02 mass % or more, the friction coefficient between metals can be increased.

The aforementioned lubricating oil composition according to the exemplary embodiment exhibits a high friction coefficient between metals to cause a large volume of torque transmission and also exhibits a long shudder prevention lifetime. Accordingly, the lubricating oil composition according to the exemplary embodiment is suitably applicable to various continuously variable transmissions such as a chain-type continuously variable transmission using a chain, a belt-type continuously variable transmission using a metallic belt and a toroidal continuously variable transmission.

Other Additives

The lubricating oil composition in the exemplary embodiment may be added as needed with other additives such as a viscosity index improver, a pour point depressant, an antiwear agent, a friction modifier, an ashless dispersant, a rust inhibitor, a metal deactivator, an antifoaming agent and an antioxidant as long as advantages of the invention are not hampered.

Examples of the viscosity index improver include polymethacrylate, dispersed polymethacrylate, olefin copolymer (e.g. ethylene-propylene copolymer), dispersed olefin copolymer and styrene copolymer (e.g. styrene-diene copolymer and styrene-isoprene copolymer). A content of the viscosity index improver is approximately in a range of 0.5 mass % to 15 mass % of the total amount of the composition in view of the blending effect thereof.

An example of the pour point depressant is polymethacrylate having a mass average molecular weight of 10000 to 150000. A preferable content of the pour point depressant is approximately in a range from 0.01 mass % to 10 mass % of the total amount of the composition.

Examples of the antiwear agent include: a sulfur antiwear agent such as a thiophosphoric acid metal salt (e.g., Zn, Pb and Sb) and a thiocarbamic acid metal salt (e.g., Zn); and a phosphorous antiwear agent such as a phosphate (tricresyl phosphate). A preferable content of the antiwear agent is approximately in a range of 0.05 mass % to 5 mass % of the total amount of the composition.

Examples of the friction modifier include a polyhydric alcohol partial ester such as neopentyl glycol monolaurate, trimethyrol propanemonolaurate, glycerin monooleate (oleic acid monoglyceride). A preferable content of the friction modifier is approximately in a range of 0.05 mass % to 4 mass % of the total amount of the composition.

Examples of the ashless dispersant include succinimides, boron-containing succinimides, benzylamines, boron-containing benzylamines, succinic acid esters, and mono- or di-carboxylic acid amides respectively represented by a fatty acid or succinic acid. A preferable content of the ashless dispersant is approximately in a range of 0.1 mass % to 20 mass % of the total amount of the composition.

Examples of the rust inhibitor include a fatty acid, alkenylsuccinic acid half ester, fatty acid soap, alkyl sulfonate, fatty acid ester of polyhydric alcohol, fatty acid amide, oxidized paraffin and alkyl polyoxyethylene ether. A preferable content of the rust inhibitor is approximately in a range from 0.01 mass % to 3 mass % of the total amount of the composition.

One of the metal deactivators such as benzotriazole and thiadiazole may be used alone or a combination of two or more thereof may be used. A preferable content of the metal deactivator is approximately in a range of 0.01 mass % to 5 mass % of the total amount of the composition.

One of the antifoaming agents such as a silicone compound and an ester compound may be used alone or a combination of two or more thereof may be used. A preferable content of the antiwear agent is approximately in a range of 0.05 mass % to 5 mass % of the total amount of the composition.

As the antioxidant, a hindered phenol-based antioxidant, amine-based antioxidant or zinc alkyldithio phosphate (ZnDTP) is preferably used. As the phenol-based antioxidant, a bisphenol-based antioxidant and an ester group-containing phenol-based antioxidant are preferable. As the amine-based antioxidant, a dialkyl diphenylamine-based antioxidant and a naphthylamine-based antioxidant are preferable. A preferable content of the antioxidant is approximately in a range of 0.05 mass % to 7 mass %.

EXAMPLES

Next, the invention will be described in more detail with reference to Examples and Comparatives. It should be noted that the invention is not limited to description of the examples and the like.

Examples 1 to 3

Comparatives 1 to 5

Lubricating oil compositions having compositions shown in Table 1 were prepared. Herein, a content of each of elements in the oils was measured in the following manner.

Nitrogen Content

A nitrogen content was measured according to JIS K2609.

Phosphorus and Calcium Contents

Phosphorus and calcium contents were measured according to JPI-5S-38-92.

Next, a friction coefficient between metals, a clutch initial shudder prevention performance and a clutch shudder prevention lifetime were measured in the following manner. The results are also shown in Table 1.

Friction Coefficient between Metals: LFW-1 Test

Using a block-on-ring tester (LFW-1) according to ASTM D2174, a coefficient of friction between metals was measured. Specific testing conditions are shown below.

Test Jigs

Ring: Falex S-10 Test Ring (SAE4620 Steel)

Block: Falex H-60 Test Block (SAE01 Steel)

Test Conditions Oil Temperature: 110 degrees C.

Load: 1176N

Slip Rate: held for five minutes each at 1.0, 0.5, 0.25, 0.125 and 0.063 m/s in this order Friction Coefficient: a measurement value for 30 seconds before changing the slip rate Trial Operation Conditions: Oil Temperature at 110 degrees C., Load at 1176N, Slip Rate at 1 m/s, and Duration of Time for 30 minutes Clutch Initial Shudder Prevention Performance The clutch initial shudder prevention performance was measured according to JASO M349-1998. $d\mu/dV$ at 50 rpm was defined as an index of shudder prevention. A larger value of $d\mu/dV$ presents better shudder prevention performance.

Friction Material: Cellulose Disc and/or Steel Plate

Oil Amount: 150 mL

Performance Measurement: Measured at 40 degrees C. of the oil temperature after the trial operation Trial Operation Conditions: Oil Temperature at 80 degrees C., Face Pressure of 1 MPa, Slip Rate at 0.6 m/s, and Duration of Time for 30 minutes Clutch Shudder Prevention Lifetime The clutch shudder prevention lifetime was measured according to JASO M349-1998. Specific testing conditions were as follows. Duration of time elapsed before reaching $d\mu/dV<0$ at 50 rpm was measured and defined as a clutch shudder prevention lifetime.

Friction Material: Cellulose Disc and/or Steel Plate

Oil Amount: 150 mL

Face Pressure: 1 MPa

Oil Temperature: 120 degrees C.

Slip Rate: 0.9 m/s

Slip Duration of Time: 30 minutes

Quiescent Time: 1 minute

Performance Measurement: Measuring $\mu$-V property at every 24 hours after the start Trial Operation Conditions: Oil Temperature at 80 degrees C., Face Pressure of 1 MPa, Slip Rate at 0.6 m/s, and Duration of Time for 30 minutes

TABLE 1

| | | Example 1 | Example 2 | Example 3 | Comparative 1 | Comparative 2 | Comparative 3 | Comparative 4 | Comparative 5 |
|---|---|---|---|---|---|---|---|---|---|
| Blend Compostion (mass %) | Base Oil [1)] | Residue | Residue | Residue | Residue | Residue | Residue | Residue | Residue |
| | Oleyl Amine: Component (A) | 0.05 | — | 0.05 | — | 0.05 | 0.05 | 0.05 | 0.05 |
| | Stearylpropylene Diamine: Component (A) | — | 0.03 | — | — | — | — | — | — |
| | Dimethyloctadecyl Amine: Component (B) | 0.4 | 0.4 | 0.4 | 0.4 | — | — | 0.4 | 0.4 |
| | Overbased Calcium Sulphonate: Component (C) | 0.4 | 0.4 | 0.4 | 0.4 | 0.4 | 0.4 | — | 0.4 |
| | 2-Ethylhexyl Hydrogen Phosphite: Component (D) | 0.25 | 0.25 | — | 0.25 | 0.25 | 0.25 | 0.25 | — |
| | 2-Ethylhexyl Acid Phosphate: Component (D) | — | — | 0.25 | — | — | — | — | — |
| | Polymethacrylate (Mw 30000) | 9.5 | 9.5 | 9.5 | 9.5 | 9.5 | 9.5 | 9.5 | 9.5 |
| | Tricresyl Phosphate | 0.3 | 0.3 | 0.3 | 0.3 | 0.3 | 0.3 | 0.3 | 0.3 |
| | Isostearate Amide | — | — | — | — | 0.4 | — | — | — |
| | oleic acid monoglyceride | 0.25 | 0.25 | 0.25 | 0.25 | 0.25 | 0.25 | 0.25 | 0.25 |
| | Polybutenyl Succinimide | 4.5 | 4.5 | 4.5 | 4.5 | 4.5 | 4.5 | 4.5 | 4.5 |
| | Sulfur Antiwear Agent | 0.5 | 0.5 | 0.5 | 0.5 | 0.5 | 0.5 | 0.5 | 0.5 |
| | Copper Diactivator (Thiadiazole-based) | 0.05 | 0.05 | 0.05 | 0.05 | 0.05 | 0.05 | 0.05 | 0.05 |
| | Antifoaming Agent (Silicone-based) | 0.2 | 0.2 | 0.2 | 0.2 | 0.2 | 0.2 | 0.2 | 0.2 |
| Element in Oil (mass %) | Nitrogen Content derived from Component (A) | 0.003 | 0.003 | 0.003 | — | 0.003 | 0.003 | 0.003 | 0.003 |
| | Nitrogen Content derived from Component (B) | 0.02 | 0.02 | 0.02 | 0.02 | — | — | 0.02 | 0.02 |
| | Calcium Content derived from Component (C) | 0.05 | 0.05 | 0.05 | 0.05 | 0.05 | 0.05 | — | 0.05 |
| | Phosphorous Content derived from Component (D) | 0.05 | 0.05 | 0.05 | 0.05 | 0.05 | 0.05 | 0.05 | — |
| Evaluation Results | LFW-1 Friction Coefficient between Metals | 0.122 | 0.121 | 0.122 | 0.121 | 0.104 | 0.121 | 0.108 | 0.109 |
| | Clutch Initial Shudder Prevention Performance dμ/dV (50 rpm) | 0.096 | 0.097 | 0.096 | 0.040 | 0.091 | 0.082 | 0.088 | 0.092 |
| | Clutch Shudder Prevention Lifetime (hours) | 348 | 348 | 336 | 336 | 192 | 48 | 312 | 312 |

[1)] Base Oil: Hydrogenated modified mineral oil (4.4 $mm^2/s$ of a kinematic viscosity at 100 degrees C., 127 of a viscosity index)

Evaluation Results

The results of Examples 1 to 3 in Table 1 show that the lubricating oil composition of the invention provided by blending all of the components (A) to (D) with the base oil exhibits a sufficient friction coefficient between metals, an excellent clutch initial shudder prevention performance and a sufficiently long clutch prevention lifetime. Accordingly, it is understood that the lubricating oil composition of the invention is preferably applicable for a continuously variable transmission.

On the other hand, since the lubricating oil compositions of Comparatives 1 to 5 do not contain one of the components (A) to (D) of the invention, a friction coefficient between metals and shudder prevention performance (initial performance and prevention lifetime) cannot be satisfied simultaneously.

The invention claimed is:

1. A lubricating oil composition, consisting essentially of:

a component (A) being a primary amine having a carbon chain moiety in a linear structure, wherein the linear structure is selected from the group consisting of a hexadecyl group, heptadecyl group, octadecyl group, nonadecyl group, eicosyl group, heneicosyl group, docosyl group, and oleyl group, and wherein an amount of the component (A) is from 0.001 to 0.1% by mass based on a total mass of the lubricating oil composition in terms of nitrogen derived from the component (A);

a component (B) being a tertiary amine represented by the formula (3):

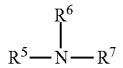

(3)

wherein $R^5$ is a hydrocarbon group having from 16 to 22 carbon atoms; and $R^6$ and $R^7$ are each independently a hydrocarbon group having 1 or 2 carbon atoms, wherein an amount of the component (B) is from 0.005 to 0.1% by mass based on the total mass of the lubricating oil composition in terms of nitrogen derived from the component (B);

a component (C) being at least one of calcium sulfonate, calcium phenate, and calcium salicylate, wherein an amount of the component (C) is from 0.01 to 0.1% by mass based on the total mass of the lubricating oil composition in terms of calcium derived from the component (C);

a component (D) being at least one of an acid phosphate and an acid phosphite, wherein an amount of the component (D) is from 0.02 to 0.09% by mass based on the total mass of the lubricating oil composition in terms of phosphorus derived from the component (D);

optionally at least one additive selected from the group consisting of a viscosity index improver, a pour point depressant, an antiwear agent, a friction modifier, an ashless dispersant, a rust inhibitor, a metal deactivator, an antifoaming agent, and an antioxidant, wherein the at least one additive is present in an amount that does not hamper the clutch shudder prevention properties of the composition; and a base oil in a balance amount.

2. The lubricating oil composition according to claim 1, wherein the component (A) is diamine.

3. A continuously variable transmission comprising the lubricating oil composition of claim 1.

4. The lubricating oil composition according to claim 1, wherein the base oil has a kinematic viscosity at 100° C. in a range of from 2 $mm^2/s$ to 15 $mm^2/s$, a pour point of −15° C. or less, a saturated hydrocarbon component of 90 mass % or more, a sulfur content of 0.03 mass % or less, and a viscosity index of 100 or more.

5. The lubricating oil composition according to claim 1, wherein the component (A) is represented by formula (1):

$$R^1—NH_2 \quad (1)$$

wherein $R^1$ is the linear structure.

6. The lubricating oil composition according to claim 2, wherein the component (A) is represented by formula (2):

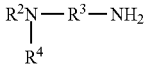

(2)

wherein $R^2$ is the linear structure; and $R^3$ has from 1 to 5 carbon atoms; and $R^4$ is selected from the group consisting of hydrogen and alkyl.

7. The lubricating oil composition according to claim 1, wherein the component (D) is represented by the formula (4) or (5):

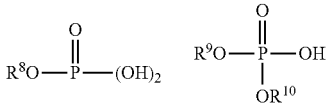

(4)

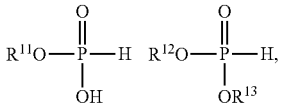

(5)

wherein each of $R^8$, $R^9$, $R^{10}$, $R^{11}$, $R^{12}$ and $R^{13}$ is independently selected from the group consisting of a hydrogen atom, methyl group, ethyl group, n-propyl group, isopropyl group, n-butyl group, isobutyl group, sec-butyl group, tert-butyl group, various pentyl groups, various hexyl groups, various heptyl groups, various octyl groups, cyclopentyl group, cyclohexyl group, allyl group, propenyl group, various butenyl groups, various hexenyl groups, various octenyl groups, cyclopentenyl group, cyclohexenyl group, phenyl group, tolyl group, xylyl group, benzyl group, phenethyl group, and methylbenzyl group.

8. The lubricating oil composition according to claim 1, wherein at least one of the viscosity index improver, the pour point depressant, the antiwear agent, the friction modifier, the ashless dispersant, the rust inhibitor, the metal deactivator, the antifoaming agent, and the antioxidant, is present in the composition.

9. The lubricating oil composition according to claim 1, wherein each of $R^6$ and $R^7$ independently is a methyl group, ethyl group, or vinyl group.

10. The lubricating oil composition according to claim 1, wherein an amount of the base oil is 79.95 mass % or higher based on the total mass of the lubricating oil composition.

* * * * *